US009746828B2

(12) United States Patent
Tanaka

(10) Patent No.: US 9,746,828 B2
(45) Date of Patent: Aug. 29, 2017

(54) SHEET DISCHARGING APPARATUS AND IMAGE FORMING APPARATUS INCLUDING THE SAME

(71) Applicant: CANON FINETECH INC., Misato-shi, Saitama (JP)

(72) Inventor: Toshinori Tanaka, Noda (JP)

(73) Assignee: Canon Finetech, Inc., Misato-shi (JP)

( * ) Notice: Subject to any disclaimer, the term of this patent is extended or adjusted under 35 U.S.C. 154(b) by 0 days.

(21) Appl. No.: 15/207,838

(22) Filed: Jul. 12, 2016

(65) Prior Publication Data

US 2017/0017199 A1 Jan. 19, 2017

(30) Foreign Application Priority Data

Jul. 17, 2015 (JP) ..... 2015-142552
Jun. 15, 2016 (JP) ..... 2016-119262

(51) Int. Cl.
*G03G 15/00* (2006.01)
*G03G 21/20* (2006.01)

(52) U.S. Cl.
CPC ..... *G03G 21/206* (2013.01); *G03G 15/6552* (2013.01); *G03G 2215/00421* (2013.01); *G03G 2221/1645* (2013.01)

(58) Field of Classification Search
CPC ..... G03G 21/206
USPC ..... 399/405
See application file for complete search history.

(56) References Cited

U.S. PATENT DOCUMENTS 8,301,055 B2 10/2012 Kojima
8,817,282 B2 8/2014 Kubo
9,092,010 B2 7/2015 Kubo
2002/0076233 A1* 6/2002 Kaiho ..... G03G 15/6552 399/92
2007/0196152 A1 8/2007 Shimizu et al.
2008/0044213 A1* 2/2008 Kato ..... G03G 15/6573 399/405
2010/0201776 A1* 8/2010 Tonami ..... G03G 21/206 347/123
2011/0188879 A1* 8/2011 Akagawa ..... G03G 21/206 399/92
2012/0194839 A1* 8/2012 Minemura ..... G03G 15/6573 358/1.13

(Continued)

FOREIGN PATENT DOCUMENTS

JP 0444251 U 4/1992
JP 09146320 A 6/1997

(Continued)

OTHER PUBLICATIONS

Japanese Office Action issued in corresponding Japanese Application No. 2016119262 dated Jul. 4, 2017.

*Primary Examiner* — Anthony Nguyen
(74) *Attorney, Agent, or Firm* — Fitzpatrick, Cella, Harper & Scinto

(57) ABSTRACT

Provided is a sheet discharging apparatus including a discharge unit configured to discharge a sheet on which a toner image has been heated and fixed, a stacking unit configured to stack the sheet discharged by the discharge unit, a suction unit configured to suck air over the stacking unit, and a cooling unit configured to blow air over the stacking unit on a downstream side of an air suction by the suction unit in a sheet discharge direction by the discharge unit.

11 Claims, 9 Drawing Sheets

(56) References Cited

U.S. PATENT DOCUMENTS

| | | | | |
|---|---|---|---|---|
| 2014/0341607 | A1* | 11/2014 | Nakano | G03G 15/2017 399/92 |
| 2015/0132020 | A1 | 5/2015 | Saito et al. | |
| 2015/0147103 | A1* | 5/2015 | Kubo | G03G 15/6552 399/405 |

FOREIGN PATENT DOCUMENTS

| | | | |
|---|---|---|---|
| JP | 2002128363 | A | 5/2002 |
| JP | 2007188043 | A | 7/2007 |
| JP | 2007-219399 | A | 8/2007 |
| JP | 2007-232949 | A | 9/2007 |
| JP | 2007331869 | A | 12/2007 |
| JP | 2009-251172 | A | 10/2009 |
| JP | 2010-145800 | A | 7/2010 |
| JP | 2010-156918 | A | 7/2010 |
| JP | 2010145880 | A | 7/2010 |
| JP | 2010181632 | A | 8/2010 |
| JP | 2011-102936 | A | 5/2011 |
| JP | 2011-107500 | A | 6/2011 |
| JP | 2013097011 | A | 5/2013 |
| JP | 2014051340 | A | 3/2014 |
| JP | 2015-094774 | A | 5/2015 |

* cited by examiner

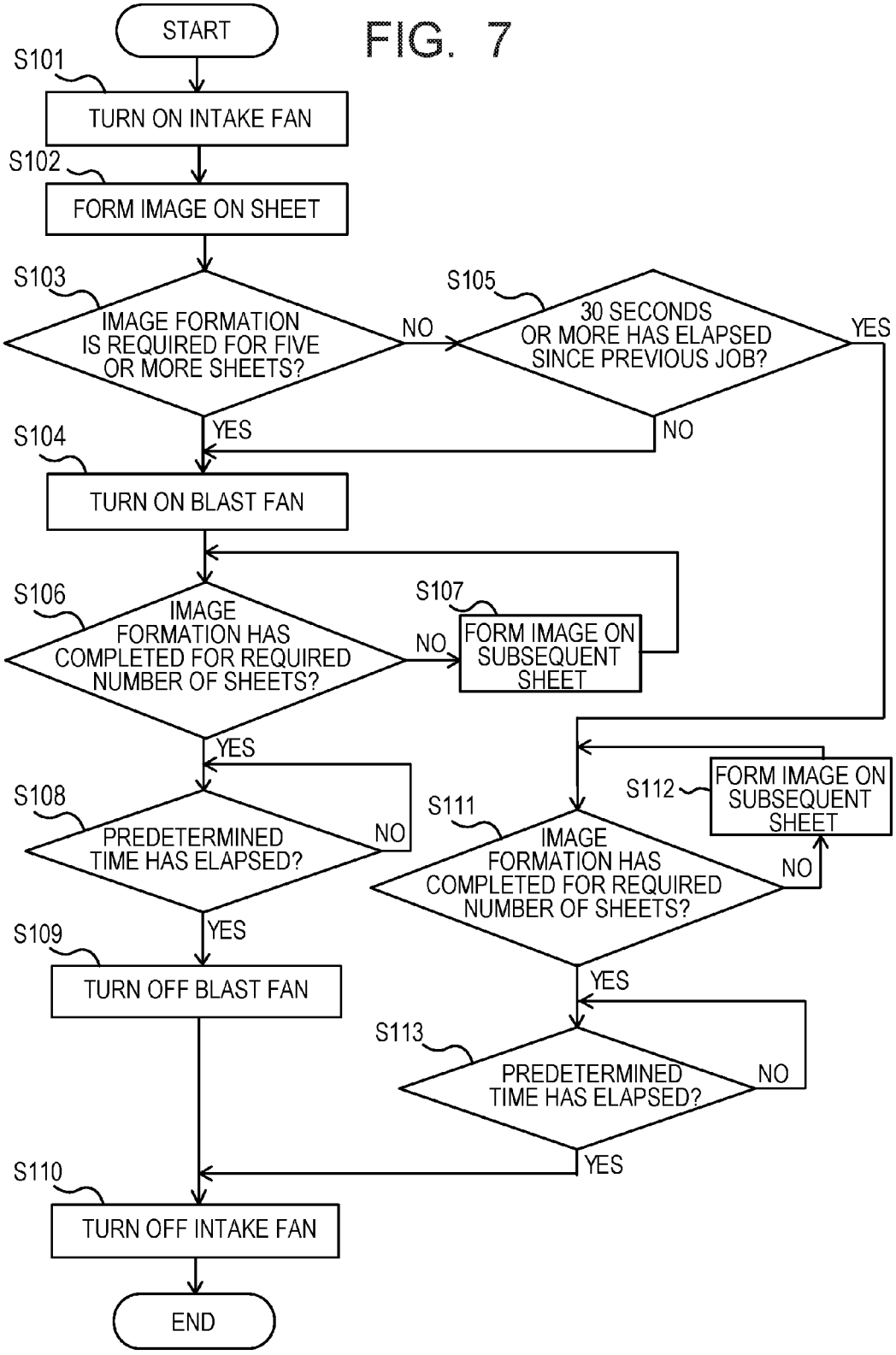
FIG. 7
START
S101
TURN ON INTAKE FAN
S102
FORM IMAGE ON SHEET
S103
IMAGE FORMATION IS REQUIRED FOR FIVE OR MORE SHEETS?
NO
S105
30 SECONDS OR MORE HAS ELAPSED SINCE PREVIOUS JOB?
YES
YES
NO
S104
TURN ON BLAST FAN
S106
IMAGE FORMATION HAS COMPLETED FOR REQUIRED NUMBER OF SHEETS?
NO
S107
FORM IMAGE ON SUBSEQUENT SHEET
YES
S108
PREDETERMINED TIME HAS ELAPSED?
NO
YES
S109
TURN OFF BLAST FAN
S111
IMAGE FORMATION HAS COMPLETED FOR REQUIRED NUMBER OF SHEETS?
NO
S112
FORM IMAGE ON SUBSEQUENT SHEET
YES
S113
PREDETERMINED TIME HAS ELAPSED?
NO
YES
S110
TURN OFF INTAKE FAN
END

SHEET DISCHARGING APPARATUS AND IMAGE FORMING APPARATUS INCLUDING THE SAME

BACKGROUND OF THE INVENTION

Field of the Invention

The present invention relates to a sheet discharging apparatus and an image forming apparatus including the same which is configured to heat a toner image so as to fix the toner image onto a sheet.

Description of the Related Art

Hitherto, an image forming apparatus, such as a copying machine, a facsimile machine, and a printer, which is configured to form a toner image on a sheet, heats the toner image together with the sheet so as to fix the toner image onto the sheet. Therefore, the sheet discharged to the discharge tray is heated. Hence, the sheets discharged to the discharge tray overlap each other to result in re-fusion of the toner image formed on the sheet. In such a case, the sheets adhere to each other through the toner. Further, when the adhering sheets are separated from each other, the sheets may be damaged.

In this context, there has hitherto been proposed an image forming apparatus that cools the sheet discharged to the discharge tray with air so as to prevent the sheets from adhering to each other (Japanese Patent Application Laid-Open No. 2010-145880).

In recent years, when a toner image is heated with a sheet, in order to reduce a volatile organic compound (VOC) as a vaporized material generated from toner or the sheet, a removing unit is provided in the apparatus to suppress an emission amount to an outside of the apparatus. However, recent image forming apparatus are required to reduce a greater amount of vaporized material released out of the apparatus. In this case, according to the conventional structure, when only a cooling fan (cooling unit) configured to cool the sheet on the discharge tray with air is arranged, some vaporized materials which cannot be removed in the apparatus may diffuse to the outside of the apparatus. Therefore, it is difficult for the related-art image forming apparatus to achieve both the cooling of the sheet and the reduction of the vaporized material.

SUMMARY OF THE INVENTION

The present invention has an object to provide a sheet discharging apparatus and an image forming apparatus including the same which is capable of efficiently cooling sheets and reducing the amount of vaporized material.

According to one embodiment of the present invention, there is provided a sheet discharging apparatus, including: a discharge unit configured to discharge a sheet on which a toner image has been heated and fixed; a stacking unit configured to stack the sheet discharged by the discharge unit; a suction unit configured to suck air over the stacking unit; and a cooling unit configured to blow air over the stacking unit on a downstream side of an air suction by the suction unit in a sheet discharge direction by the discharge unit.

Further features of the present invention will become apparent from the following description of exemplary embodiments with reference to the attached drawings.

BRIEF DESCRIPTION OF THE DRAWINGS

FIG. 3 is viewed from a direction of the arrow V.

FIG. 7 is a flowchart for illustrating operations of the intake fan and the blast fan.

DESCRIPTION OF THE EMBODIMENTS

Now, an image forming apparatus 1 according to an embodiment of the present invention is described with reference to the drawings. The numerical values in the embodiment are merely reference numerical values, and are not numerical values that limit the present invention.

Figure 1:
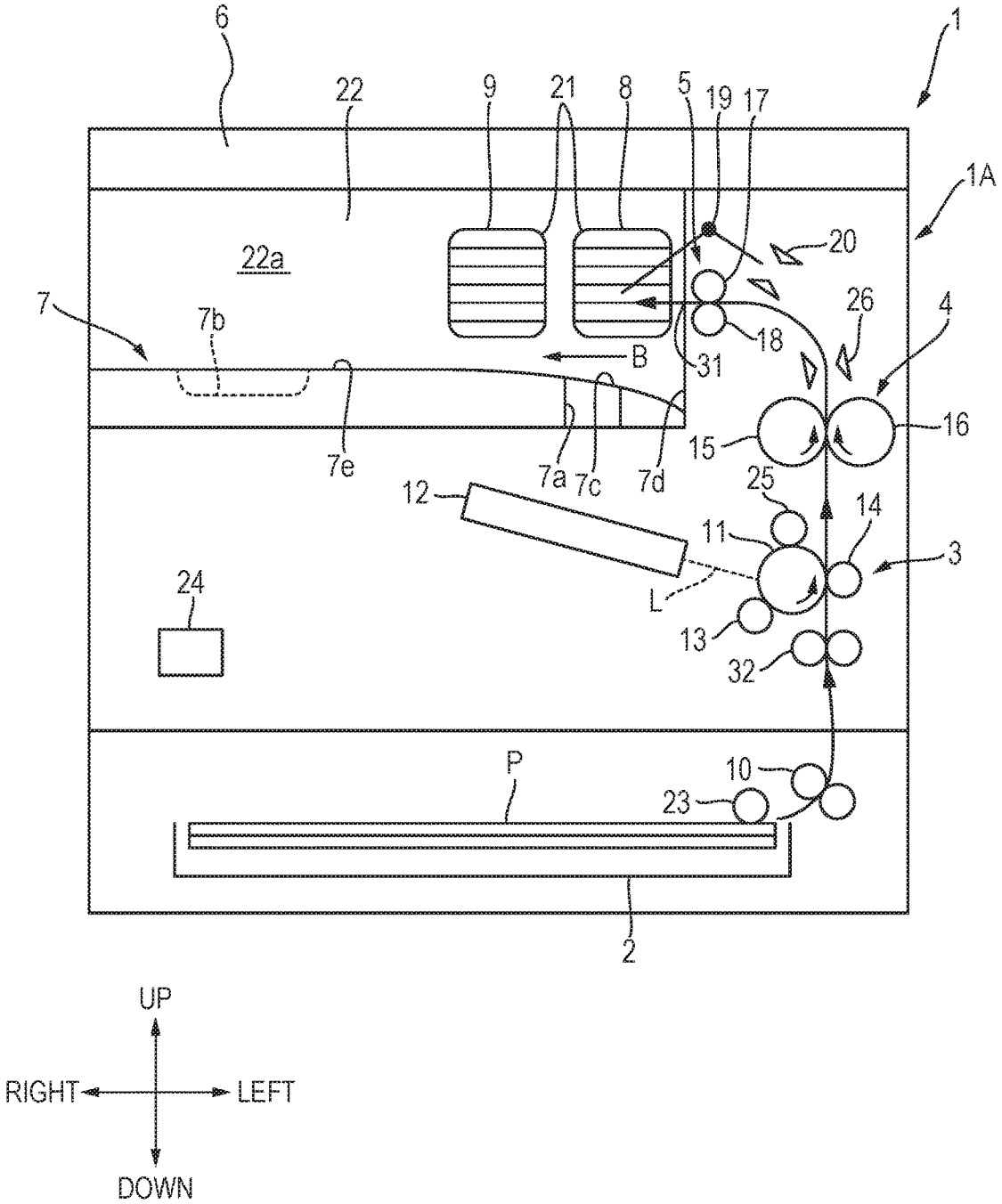
FIG. 1 is a sectional view of an image forming apparatus taken along a sheet conveying direction according to an embodiment of the present invention.

FIG. 1 is a sectional view of the image forming apparatus 1 taken along a sheet conveying direction according to the embodiment of the present invention. As the image forming apparatus, a copying machine, a facsimile machine, a printer, and other apparatus are given.

The image forming apparatus 1 includes a cassette 2 configured to receive sheets P therein, which is provided in a lower part of an apparatus main body 1A. A pickup roller 23 feeds the sheet P from the cassette 2. A conveyance roller pair 10 brings a distal end of the sheet P fed from the cassette 2 into abutment against a registration roller pair 32 being in a rotation stopped state so as to warp the sheet. In this manner, when the sheet is skewed, the sheet is corrected to be straight.

Meanwhile, an image reading apparatus 6 reads an original (not shown) so as to transmit image data to a laser unit 12. The laser unit 12 emits a laser beam L onto a photosensitive drum 11 of an image forming section 3 based on image information. The photosensitive drum 11 is charged by a charger 25. A latent image is formed on the photosensitive drum 11 by the laser beam L. The latent image is developed into a toner image with toner by a developing device 13 so as to form a visualized image.

The registration roller pair 32 feeds the sheet between the photosensitive drum 11 and a transfer device 14 in alignment with a position of the toner image formed on the photosensitive drum 11. The transfer device 14 rotates to transfer the toner image, which is formed on the photosensitive drum 11, onto the sheet and feeds the sheet to a fixing device 4 in cooperation with the photosensitive drum 11. The fixing device 4 includes a heating roller 15 and a pressure roller 16. The toner image is heated and pressurized together with the sheet by the heating roller 15 and the pressure roller 16 so as to be fixed onto the sheet. The image forming section 3 and the fixing device 4 construct an image forming unit configured to form the toner image, transfer the toner image onto the sheet, and heat the toner image formed on the sheet so as to fix the toner image onto the sheet. When an image-fixed sheet discharge sensor 26 detects the sheet, sheet discharge rollers 17 and sheet discharge driven rollers 18 of a discharge roller pair 5 rotate to discharge the sheet from a discharge port 31 to a discharge tray 7. Specifically, the discharge roller pair 5 serving as a discharge unit discharges the sheet that has been heated to fix the toner image thereon to the discharge tray 7 serving as the stacking unit and stacks the sheet thereon. A discharge-detecting sensor 20 detects the discharge of the sheet to the discharge tray 7 based on rotation of a flag 19 that is rotated by the sheet. The discharge tray 7 is an in-body discharge tray that is formed in a lower part of an in-body space 22 formed inside the apparatus main body 1A. An intake fan 8 and a blast fan 9, which are described below, are provided on a back surface wall 22*a* that forms the in-body space 22 so as to be oriented from the back surface wall 22*a* to a front side.

Figure 2:
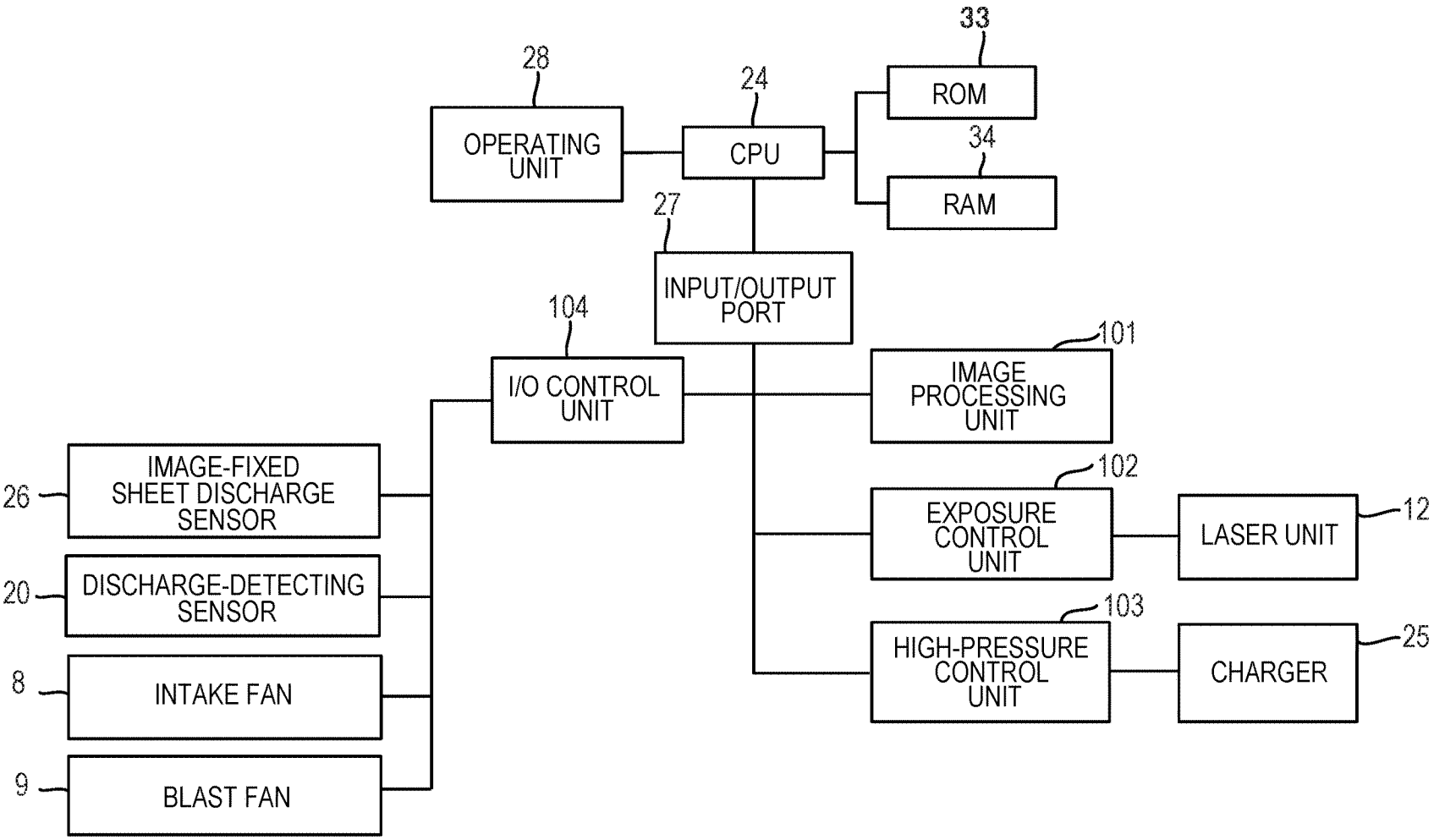
FIG. 2 is a control block diagram of the image forming apparatus according to the embodiment of the present invention.

FIG. 2 is a control block diagram of the image forming apparatus 1. A CPU 24 is an information processing circuit configured to perform basic control over the image forming apparatus 1. A ROM 33 in which a control program is written, a RAM 34 configured to temporarily store information being currently subjected to image formation processing in the image forming apparatus 1, and an operating unit 28 through which a user inputs image formation information to the image forming apparatus 1 are connected to the CPU 24. A partial area of the RAM 34 has a backup function to prevent data from being erased even when power is turned OFF.

Further, an image processing unit 101, an exposure control unit 102, a high-pressure control unit 103, and other units are also connected to the CPU 24 through an input/output port 27. The image processing unit 101 processes the image information read by the image reading apparatus 6. The exposure control unit 102 controls the laser unit 12 so that the laser unit 12 can emit the laser beam L onto the photosensitive drum 11 of the image forming section 3 based on the image information output from the image processing unit 101. The high-pressure control unit 103 controls a voltage used by the charger 25 to charge the photosensitive drum 11. Still further, the image-fixed sheet discharge sensor 26, the discharge-detecting sensor 20, the intake fan 8, the blast fan 9, and other units are also connected to the CPU 24 through an I/O control unit 104.

The CPU 24 sequentially controls the respective units based on the control program written in the ROM 33, sheet detection information output from the image-fixed sheet discharge sensor 26 and the discharge-detecting sensor 20 through the input/output port 27, and other information so as to perform image formation processing. Further, the CPU 24 controls the respective units based on the image formation information input to the operating unit 28 by the user and displays operating states of the respective units on the operating unit 28.

Figure 3:
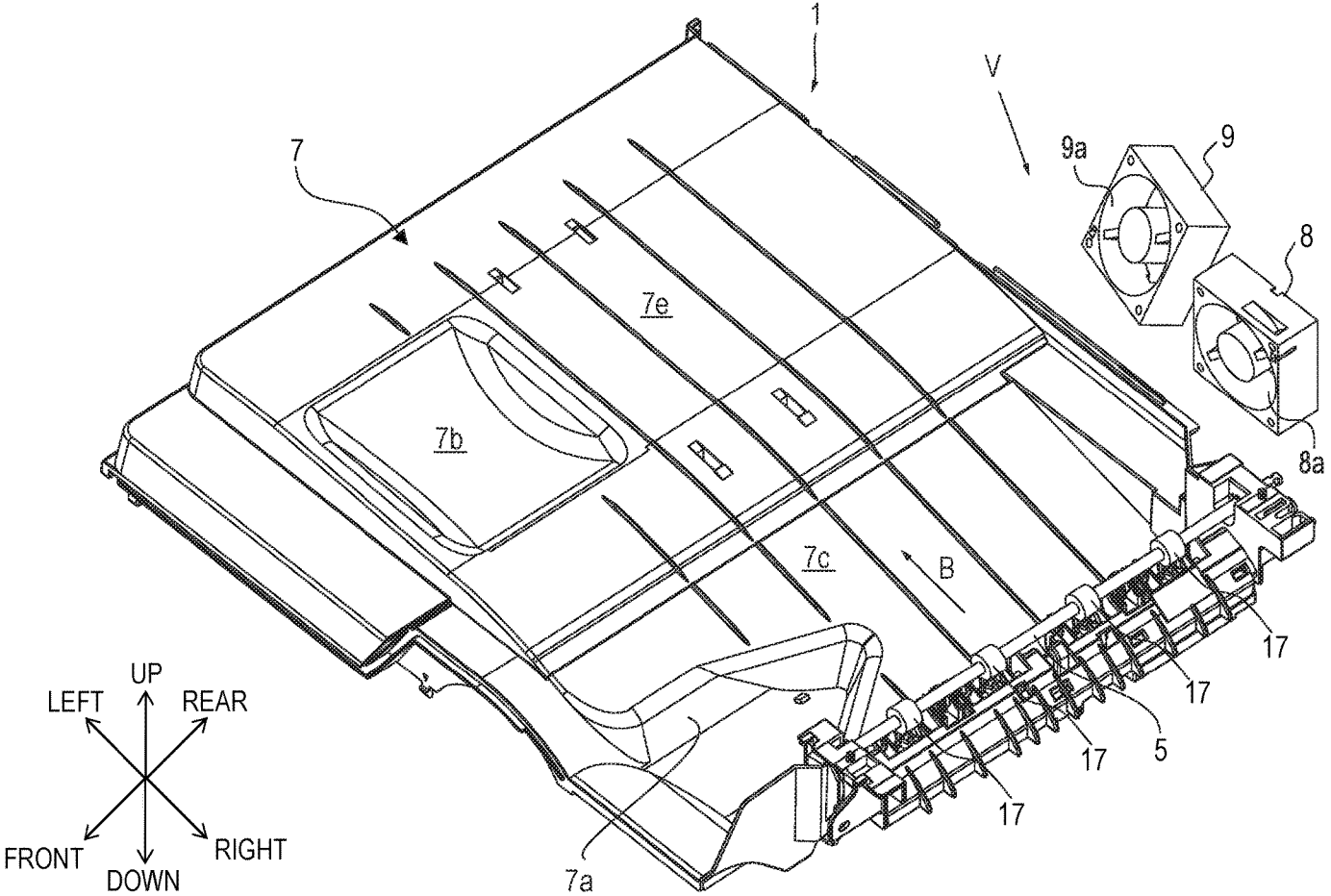
FIG. 3 is a perspective view of a discharge roller pair, a discharge tray, an intake fan, and a blast fan of the image forming apparatus illustrated in FIG. 1.
Figure 4:
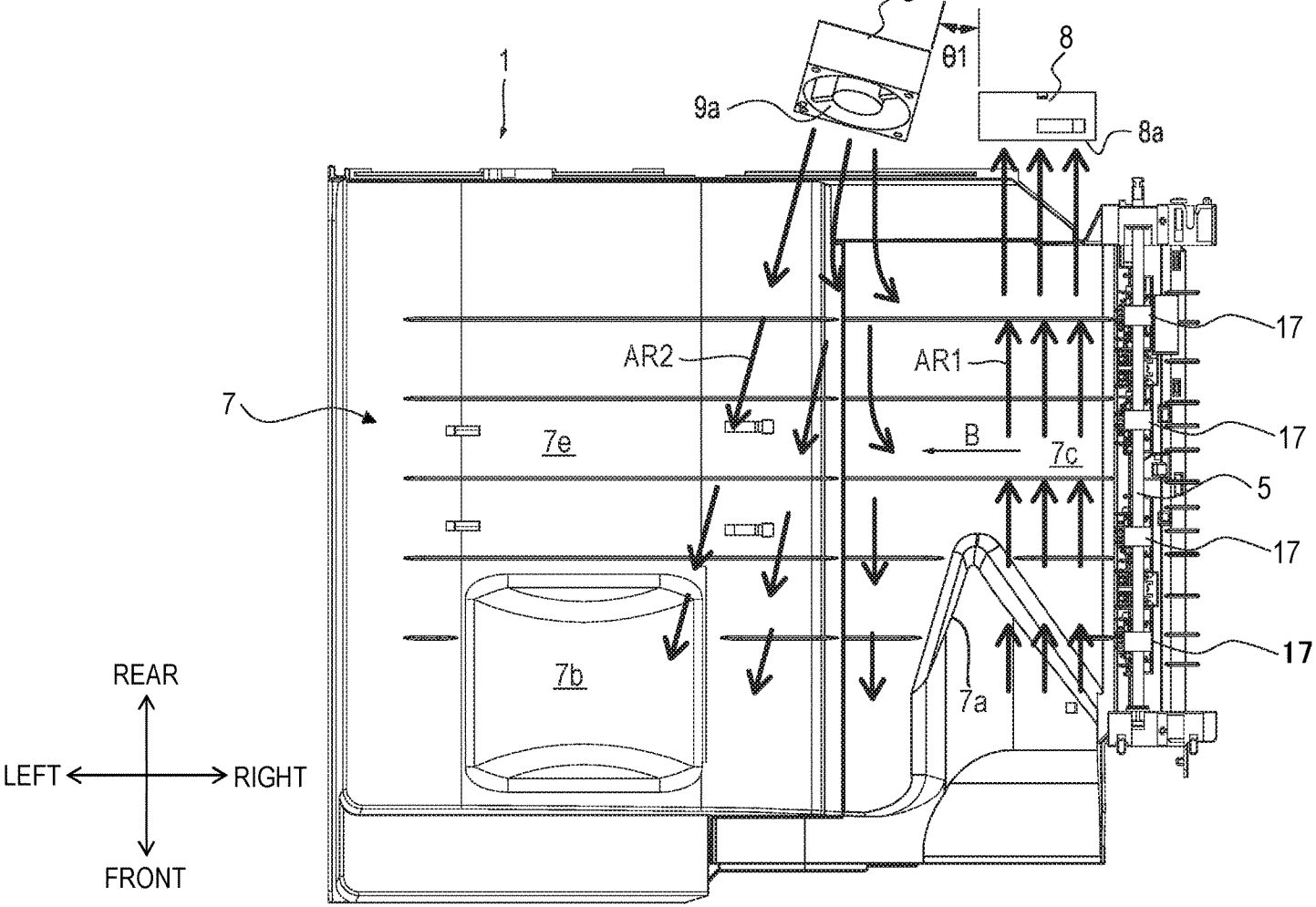
FIG. 4 is a plan view of the discharge roller pair, the discharge tray, the intake fan, and the blast fan of the image forming apparatus illustrated in FIG. 1.
Figure 5:
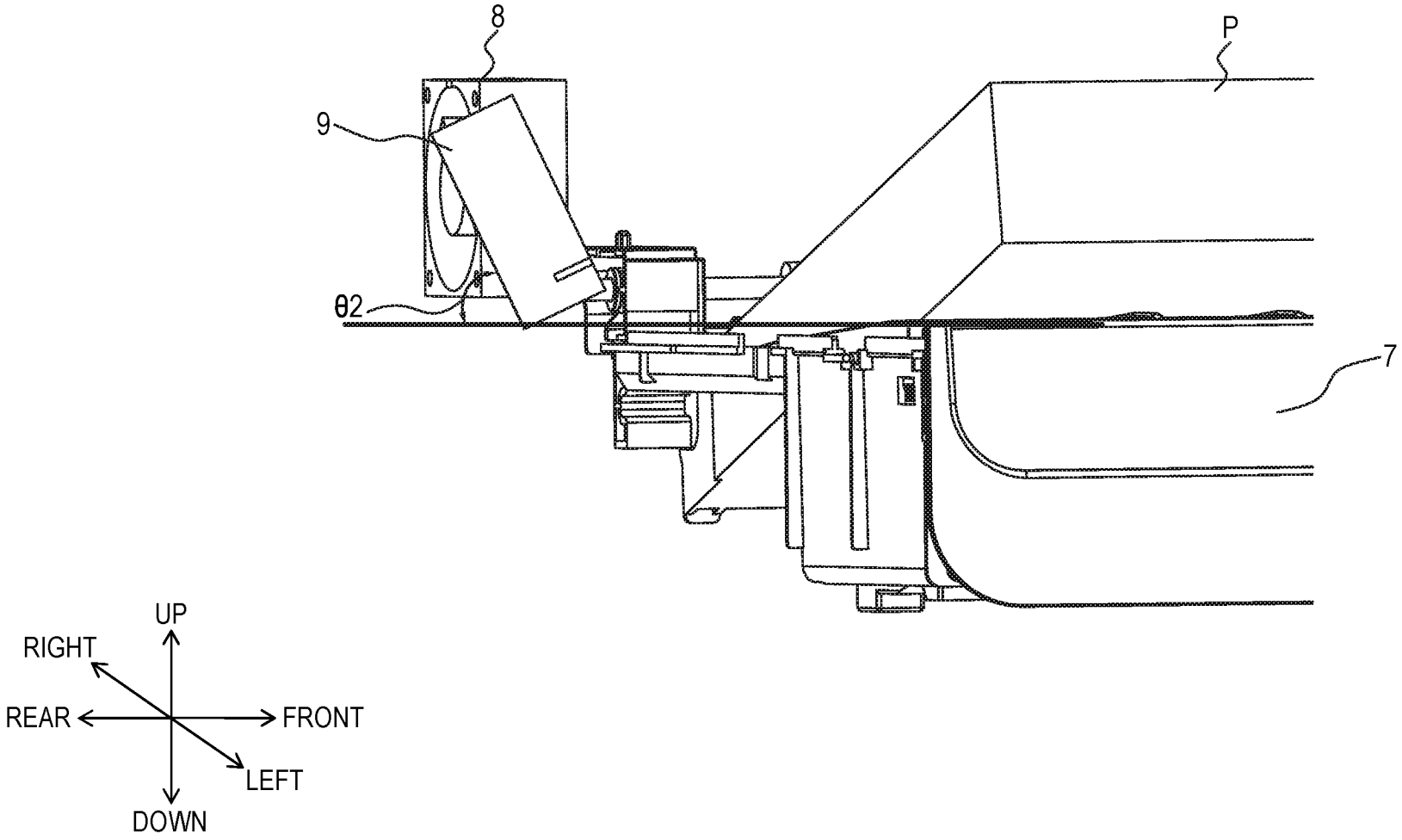
FIG. 5 is a perspective view of the discharge tray, the intake fan, and the blast fan when
Figure 6:
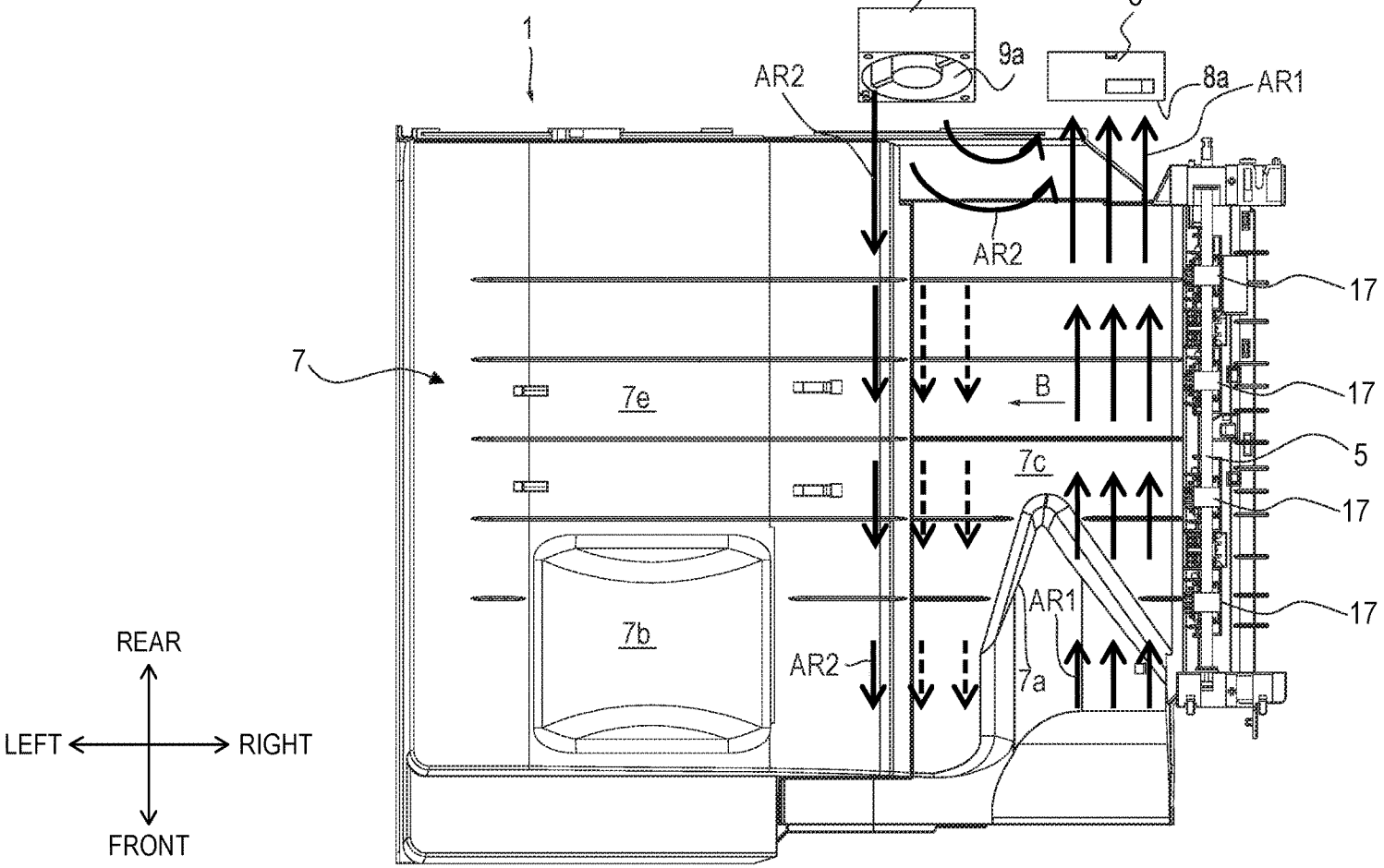
FIG. 6 is a plan view corresponding to FIG. 4 when the intake fan and the blast fan are oriented in the same direction on a projection view onto a horizontal plane.

Next, referring to FIG. 1 and FIG. 3 to FIG. 7, a positional relationship between the intake fan 8 and the blast fan 9 with respect to the discharge tray 7 of the image forming apparatus 1 and operations of the intake fan 8 and the blast fan 9 are described. FIG. 3 is a perspective view of the discharge roller pair 5, the discharge tray 7, the intake fan 8, and the blast fan 9 of the image forming apparatus 1 illustrated in FIG. 1. FIG. 4 is a plan view of the discharge roller pair 5, the discharge tray 7, the intake fan 8, and the blast fan 9 of the image forming apparatus 1 illustrated in FIG. 1. FIG. 5 is a perspective view of the discharge tray 7, the intake fan 8, and the blast fan 9 when FIG. 3 is viewed from a direction of the arrow V. FIG. 6 is a plan view corresponding to FIG. 4 when the intake fan 8 and the blast fan 9 are oriented in the same direction on a projection view onto a horizontal plane. FIG. 7 is a flowchart for illustrating the operations of the intake fan 8 and the blast fan 9. Note that the back surface wall 22*a* is not shown in FIG. 3 to FIG. 6.

In FIG. 1, FIG. 3, and FIG. 4, a notch portion 7*a* and a concave portion 7*b* are formed on an upper surface 7*e* of the discharge tray 7 so as to allow the user to easily pick and remove the sheet discharged on the discharge tray 7. A portion of the upper surface 7*e* of the discharge tray 7, which is located close to the discharge roller pair 5, is an inclined portion 7*c* that is inclined downward as approaching to the discharge roller pair 5. With the inclined portion 7*c*, the sheet discharged to the discharge tray 7 slides down toward the discharge roller pair 5 under a self-weight to be received by a wall surface 7*d*, which is located below the discharge roller pair 5, thereby aligning a trailing edge of the sheet.

In FIG. 1, the intake fan 8 and the blast fan 9 are respectively provided in ventilation ports 21 formed in the back surface wall 22*a* that forms the in-body space 22 so that the intake fan 8 and the blast fan 9 are oriented from the back surface wall 22*a* to the front side. The intake fan 8 and the blast fan 9 are positioned to be recessed backward from the back surface wall 22*a* without projecting from the back surface wall 22*a* toward the discharge tray 7 so that the sheet is not caught on front surfaces thereof.

The intake fan 8 is arranged in the vicinity of the discharge roller pair 5, and is oriented in a direction (sheet width direction) perpendicular to (intersecting with) a sheet discharge direction B by the discharge roller pair 5, which is along the upper surface 7*e* of the discharge tray 7. Therefore, the intake fan 8 sucks air AR1 above the discharge tray 7 from the front side to a rear side (back side) of the image forming apparatus 1. Specifically, the intake fan 8 serving as a suction unit is arranged on a side (back side) of one lateral end of the discharge tray 7 in the sheet discharge direction B so as to suck a vaporized material floating on the sheet that is discharged to the discharge tray 7 in the sheet width direction. The vaporized material includes a volatile organic compound (VOC). The volatile organic compound is a gas that is generated from the toner or the sheet when the fixing device 4 heats the toner image together with the sheet.

A duct (not shown) communicating to the outside of the apparatus main body 1A is provided behind the intake fan 8. A filter (not shown) for preventing the vaporized material sucked by the intake fan 8 from being diffused outside of the apparatus is provided inside the duct.

The vaporized material is generated when the fixing device 4 heats and pressurizes the sheet and the toner image, and may flow out from the discharge port 31 together with the sheet discharged to the discharge tray 7 by the discharge roller pair 5. Therefore, the intake fan 8 sucks the vaporized material flowing out from the discharge port 31 and the vaporized material floating above the sheet that is discharged to the discharge tray 7 in the sheet width direction, thereby being capable of preventing an odor of the vaporized material or the like from leaking out of the apparatus main body 1A of the image forming apparatus 1. In addition, the intake fan 8 is located on an upstream side of the blast fan 9 in the sheet discharge direction B. Therefore, the intake fan 8 can quickly suck the vaporized material generated from the sheet discharged by the discharge roller pair 5, thereby being capable of preventing the vaporized material from being diffused from the in-body space 22 to the outside of the image forming apparatus 1.

Further, the intake fan 8 also sucks the air inside the in-body space 22, and therefore can suppress temperature rise in the in-body space 22, thereby being capable of preventing the toner image from being re-fused by the sheet having heat that is discharged to the discharge tray 7. Therefore, the sheets can be prevented from adhering to each other due to the re-fusion of the toner image, thereby being capable of preventing the toner image from being damaged.

The blast fan (cooling unit) 9 is arranged on a side (back side) of the one lateral end of the discharge tray 7 in the sheet discharge direction B and on a downstream side of the air inlet port 8*a* of the intake fan 8 in the sheet discharge direction B so as to blow air AR2 toward the upper surface 7*e* of the discharge tray 7 from the rear side (back side) to the front side. As illustrated in FIG. 4, the air outlet port 9*a* of the blast fan 9 is oriented at an angle θ1 with respect to the air inlet port 8*a* of the intake fan 8. Namely, an air blowing direction of the blast fan 9 is oriented with respect to a sucking direction of the intake fan 8 so as to be inclined to the downstream side in the sheet discharge direction B. Further, as illustrated in FIG. 5, the air outlet port 9*a* the blast fan 9 is oriented upward (in an upward direction) at an angle (elevation angle) θ2 with respect to the upper surface (sheet stacking surface) 7*e* of the discharge tray 7. A duct (not shown) communicating to the outside of the apparatus main body 1A is provided behind the blast fan 9.

Therefore, the blast fan 9 can blow the air AR2 approximately in the sheet width direction to cool the sheet so as to suppress the temperature rise in the in-body space 22, thereby being capable of preventing the re-fusion of the toner image. Therefore, the adhesion of the sheets due to the re-fusion of the toner image can be prevented, thereby being capable of preventing the toner image from being damaged.

The blast fan 9 is inclined at the angle θ1. Therefore, in comparison to a case where the blast fan 9 is arranged so that the air blowing direction of the blast fan 9 is parallel to the sucking direction of the intake fan 8 as illustrated in FIG. 6, the air AR2 blown from the blast fan 9 is less likely to be pulled and sucked together with the air AR1 sucked by the intake fan 8. Specifically, reduction in the amount of air blown by the blast fan 9 configured to circulate the air in the in-body space 22 can be eased, thereby being capable of further enhancing a cooling effect for the sheets on the discharge tray 7. Further, as illustrated in FIG. 5, the blast fan 9 is oriented upward at the elevation angle θ2. Therefore, the air can be blown above a maximum stacking height to which the sheets can be stacked at maximum on the discharge tray 7. Thus, the in-body space 22 can be easily cooled.

In the description given above, the air inlet port 8*a* of the intake fan 8 may be oriented toward the discharge roller pair 5 so as to prevent the vaporized material from flowing out through the discharge port 31 along with the discharge of the sheet. Even in this case, the intake fan 8 can suck the vaporized material in the sheet width direction. In any case, the sucking direction of the intake fan 8 and the air blowing direction of the blast fan 9 only need to be respectively oriented in directions separating away from each other. According to this structure, the suction of the air blown by the blast fan 9 into the intake fan 8 can be suppressed, thereby being capable of enhancing suction efficiency for the vaporized material and cooling efficiency for the sheets P and the in-body space 22. Further, the vaporized material can be sucked by the intake fan 8 before it diffuses by the air blown by the blast fan 9, so that suction efficiency for the vaporized material can be enhanced.

Figure 8:
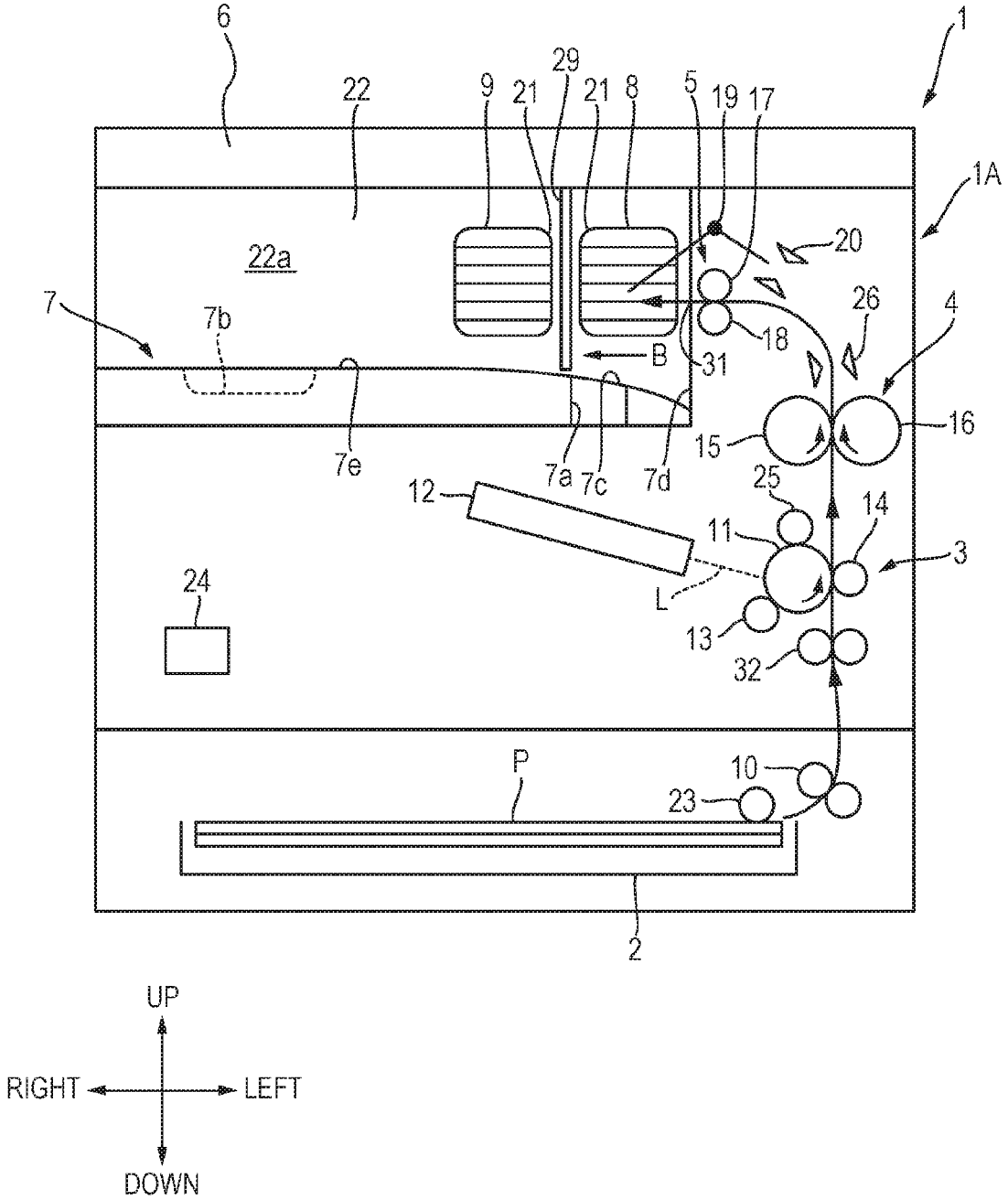
FIG. 8 is a view in a case where a shielding member is provided between an air inlet port of the intake fan and an air outlet port of the blast fan in the image forming apparatus according to the embodiment of the present invention.
Figure 9:
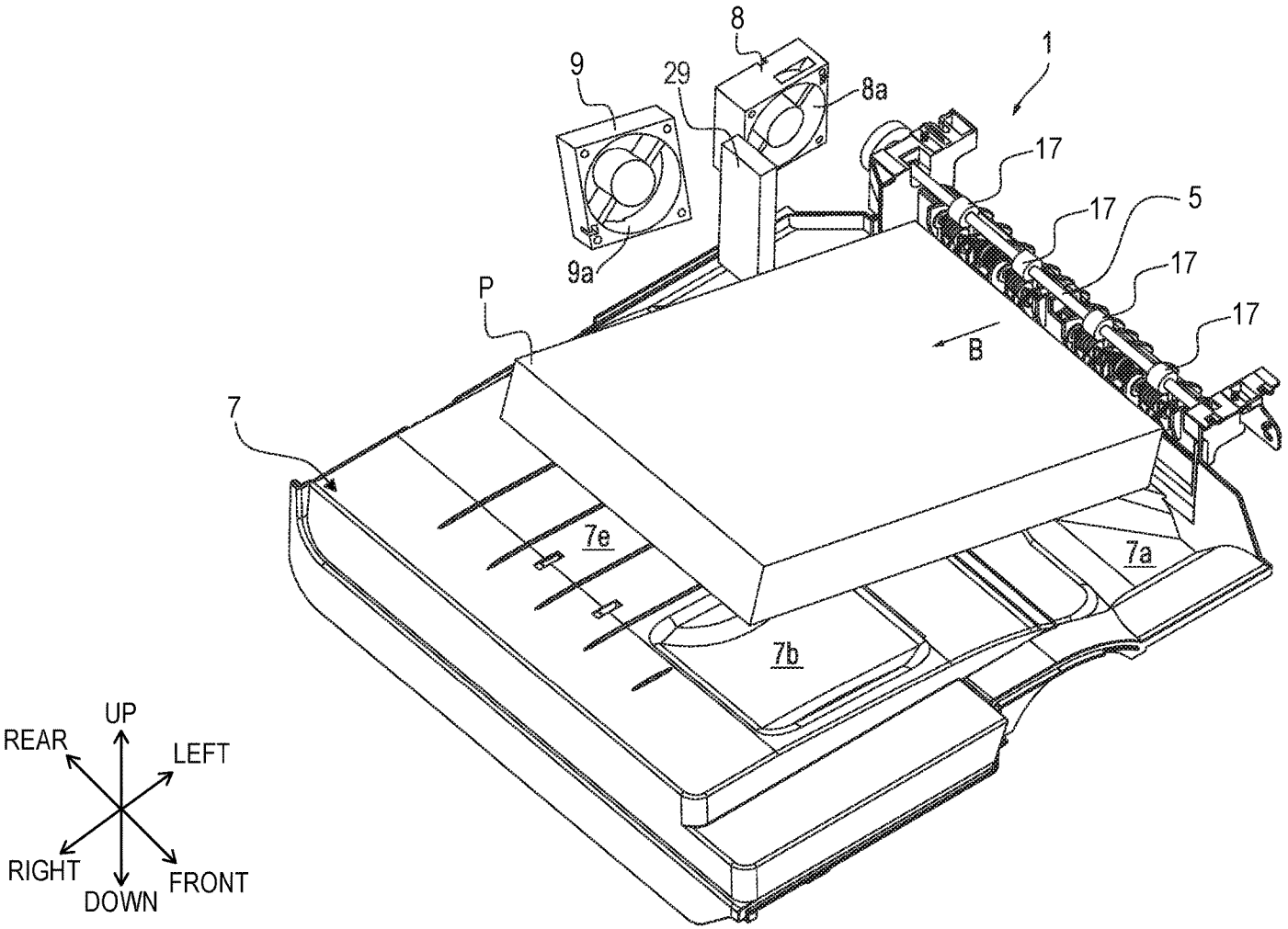
FIG. 9 is a perspective view of the discharge roller pair, the discharge tray, the intake fan, the blast fan, and the shielding member in the image forming apparatus illustrated in FIG. 8.

A shielding member 29 may be provided between an air inlet port 8*a* of the intake fan 8 and an air outlet port 9*a* of the blast fan 9 so as to suppress the suction of the air blown by the blast fan 9 into the intake fan 8, as illustrated in FIG. 8 and FIG. 9. FIG. 8 is a view in a case where the shielding member 29 is provided between the air inlet port 8*a* of the intake fan 8 and the air outlet port 9*a* of the blast fan 9 in the image forming apparatus 1 according to the embodiment of the present invention. FIG. 9 is a perspective view of the discharge roller pair 5, the discharge tray 7, the intake fan 8, the blast fan 9, and the shielding member 29 in the image forming apparatus 1 illustrated in FIG. 8. Note that the back surface wall 22*a* is not shown in FIG. 9.

As described above, by providing the shielding member 29, the suction of the air blown by the blast fan 9 into the intake fan 8 can be suppressed, so that suction efficiency for the vaporized material and cooling efficiency for the sheets P and the in-body space 22 can be enhanced.

Next, a relationship between an overall operation of the image forming apparatus 1 and operations of the intake fan 8 and the blast fan 9 is described referring to FIG. 7. A flowchart of FIG. 7 is implemented by the CPU 24 when the program stored in the ROM 33 is read out.

When an instruction of a print job is received from the user through the operating unit 28, the CPU 24 activates the intake fan 8 (Step S101). The sheet P placed in the cassette 2 is conveyed to the image forming section 3 by the pickup roller 23, the conveyance roller pair 10, and the registration roller pair 32. Meanwhile, the exposure control unit 102 controls the laser unit 12 to emit the laser beam L onto the photosensitive drum 11 in accordance with the image data transferred from the image reading apparatus 6. At this time, the photosensitive drum 11 is already charged by the charger 25 that is actuated by the control of the high-pressure control unit 103. The latent image formed on the photosensitive drum 11 is developed with the toner by the developing device 13 to form the toner image. The photosensitive drum 11 and the transfer device 14 transfer the toner image onto the sheet P conveyed from the cassette 2. Then, the fixing device 4 fixes the toner image onto the sheet. In this manner, the image is formed on the sheet (Step S102). Then, the CPU 24 determines the number of sheets on which the image is required to be formed (image formation request sheet number) as requested by the user through the operating unit 28 (Step S103).

In the case where the image is formed on a small number of sheets, a heat capacity as a sheet bundle is small. Therefore, a temperature is sufficiently lowered through natural heat radiation within a short period of time. Hence, the sheets are not required to be cooled. Therefore, when image formation sheet number information obtained through the operating unit 28 indicates the number of sheets smaller than a predetermined image formation sheet number, the CPU 24 does not activate the blast fan 9 so as to enhance suction efficiency of the intake fan 8 for the vaporized material. When the image formation sheet number information indicates the number of sheets equal to or larger than the predetermined image formation sheet number, the CPU 24 activates the blast fan 9. Specifically, for example, when the image formation request sheet number is five or larger (Yes in Step S103), the CPU 24 activates the blast fan 9 (Step S104) to cool the discharged sheets.

When the image formation request sheet number is smaller than five (No in Step S103), the CPU 24 determines whether or not, for example, 30 seconds (reference numerical value) or longer has elapsed since an end of the image formation for the previous job (Step S105). When the elapsed time since the end of the image formation for the previous job is shorter than 30 seconds (No in Step S105), the blast fan 9 is activated (Step S104) to cool the discharged sheets. The reason is as follows. In the case where the sheets P for a current job are stacked on the discharge tray 7 provided in the in-body space 22 under a state in which a time interval between the previous job and the current job is short, temperature decrease through the natural heat radiation becomes slower even when the number of sheets stacked on the discharge tray 7 is small. Then, the CPU 24 determines whether or not the image has been formed on the number of sheets requested by the user (Step S106). When the image has not been formed on the number of sheets requested by the user (No in Step S106), the image is formed on a subsequent sheet (Step S107).

Then, after the end of the formation of the image on the number of sheets requested by the user (Yes in Step S106), the CPU 24 determines whether or not predetermined time has elapsed so as to determine whether or not the suction of the vaporized material and the cooling of the sheets and the in-body space 22 have been completed (Step S108). When the predetermined time has not elapsed (No in Step S108), the suction by the intake fan 8 and the blowing of the air by the blast fan 9 are continued until the predetermined time elapses. After the elapse of the predetermined time (Yes in Step S108), the blast fan 9 is stopped (Step S109), and then the intake fan 8 is stopped (Step S110).

In Step S105, when the elapsed time since the end of the image formation for the previous job is equal to or longer than 30 seconds (Yes in Step S105), the CPU 24 does not activate the blast fan 9 and the processing proceeds to Step S111. The CPU 24 determines whether or not the image has been formed on the number of sheets requested by the user (Step S111). When the image has not been formed on the number of sheets requested by the user (No in Step S111), the image is formed on a subsequent sheet (Step S112).

Then, after the end of the formation of the image on the number of sheets requested by the user (Yes in Step S111), the CPU 24 determines whether or not predetermined time has elapsed so as to determine whether or not the suction of the vaporized material has been completed (Step S113). When the predetermined time has not elapsed (No in Step S113), the suction by the intake fan 8 is continued until the predetermined time elapses. After the elapse of the predetermined time (Yes in Step S113), the intake fan 8 is stopped (Step S110).

As described above, while the discharge roller pair 5 is performing the sheet discharging operation, the intake fan 8 performs the air intake operation. Further, the blast fan 9 is activated when the image formation sheet number is equal to or larger than the predetermined image formation sheet number and is not activated when the image formation sheet number is smaller than the predetermined image formation sheet number. However, even when the image formation sheet number is smaller than the predetermined image formation sheet number, the blast fan 9 is activated before the discharge roller pair 5 starts discharging a first sheet for a subsequent job when the time interval between the current job and the subsequent job is shorter than a predetermined time interval.

As described above, the image forming apparatus 1 of this embodiment is capable of efficiently suppressing the diffusion of the vaporized material that is discharged along with the discharge of the sheet by the discharge roller pair 5 and therefore capable of further suppressing an odor or the like unpleasant to the user, thereby being capable of improving product quality of the image forming apparatus. The image forming apparatus 1 of this embodiment is capable of efficiently lowering the temperature of the sheets stacked on the discharge tray 7. Therefore, the adhesion of the sheets due to the re-fusion of the toner can be prevented.

The sheet discharging apparatus according to the present invention is capable of efficiently cooling the sheets and reducing the amount of vaporized material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-142552, filed Jul. 17, 2015, and No. 2016-119262, filed Jun. 15, 2016 which are hereby incorporated by reference herein in their entirety.

What is claimed is:

1. A sheet discharging apparatus, comprising:

a discharge unit configured to discharge a sheet on which a toner image has been heated and fixed;

a stacking unit configured to stack the sheet discharged by the discharge unit;

a suction unit configured to suck air over the stacking unit; and a cooling unit configured to blow air over the stacking unit on a downstream side of an air suction by the suction unit in a sheet discharge direction by the discharge unit.

2. A sheet discharging apparatus according to claim 1, wherein the suction unit is configured to suck the air in a direction intersecting with the sheet discharge direction, and wherein the cooling unit is configured to blow the air in a direction intersecting with the sheet discharge direction and away from a sucking direction by the suction unit.

3. A sheet discharging apparatus according to claim 1, wherein the suction unit is provided on a downstream side of the discharge unit in the sheet discharge direction, and wherein the cooling unit is provided on a downstream side of the suction unit in the sheet discharge direction.

4. A sheet discharging apparatus according to claim 1, wherein the suction unit is configured to suck the air from a discharge port direction in which the sheet is discharged by the discharge unit.

5. A sheet discharging apparatus according to claim 1, wherein the cooing unit is configured to blow the air in a direction inclined to the downstream side in the sheet discharge direction.

6. A sheet discharging apparatus according to claim 1, wherein the cooling unit is configured to blow the air in an upward direction with respect to a sheet stacking surface of the stacking unit.

7. A sheet discharging apparatus according to claim 1, further comprising a shielding member provided between an air inlet port of the suction unit and an air outlet port of the cooling unit.

8. A sheet discharging apparatus according to claim 1, wherein the suction unit is configured to suck the air over the stacking unit while the discharge unit is discharging the sheet.

9. A sheet discharging apparatus according to claim 1, wherein the cooling unit is configured to blow the air over the stacking unit when a number of sheets discharged by the discharge unit is equal to or larger than a predetermined number of sheets.

10. A sheet discharging apparatus according to claim 9, wherein the cooling unit is configured to blow the air over the stacking unit before the discharge unit discharges a first sheet for a second job subsequent to a first job when a time interval between the first job and the second job implemented by an image forming unit which forms the toner image on the sheet discharged by the discharge unit is a predetermined time interval or shorter.

11. An image forming apparatus, comprising:

the sheet discharging apparatus according to claim 1;

an image forming unit configured to form the toner image on the sheet discharged by the discharge unit.

* * * * *